US005997418A

United States Patent [19]

Tavares et al.

[11] Patent Number: 5,997,418

[45] Date of Patent: Dec. 7, 1999

[54] GOLF BALL HAVING CIRCULAR GROUPS OF TEAR DROPPED DIMPLES

[75] Inventors: Gary Tavares, Sturbridge, Mass.; Steven Green, Syracuse, N.Y.

[73] Assignee: Spalding Sports Worldwide, Inc.

[21] Appl. No.: 09/188,206

[22] Filed: Nov. 9, 1998

[51] Int. Cl.[6] ..... A63B 37/14

[52] U.S. Cl. ..... 473/384

[58] Field of Search ..... 473/383, 384

[56] References Cited

U.S. PATENT DOCUMENTS

D. 319,676 9/1991 Ihara .
1,517,514 12/1924 Hunt .
4,869,512 9/1989 Nomura et al. ..... 473/383
5,123,652 6/1992 Oka .
5,377,989 1/1995 Machin .
5,503,398 4/1996 Lu .
5,735,756 4/1998 Steifel et al. .

*Primary Examiner*—George J. Marlo
*Attorney, Agent, or Firm*—Laubscher & Laubscher

[57] ABSTRACT

A golf ball having improved aerodynamic efficiency is characterized by the arrangement of a plurality of modified tear-drop shaped dimples arranged on the surface thereof. The ball has a dimple-free equator which divides the ball into two identical hemispheres, each of which is broken into equal quadrants by two great circles passing through the poles of the ball. Each quadrant has a maximum circular area filled with a first plurality of tear-drop shaped dimples. A second plurality of tear-drop shaped dimples is arranged between the circular areas so that the dimple coverage on the ball is maximized.

13 Claims, 3 Drawing Sheets

FIG. 1
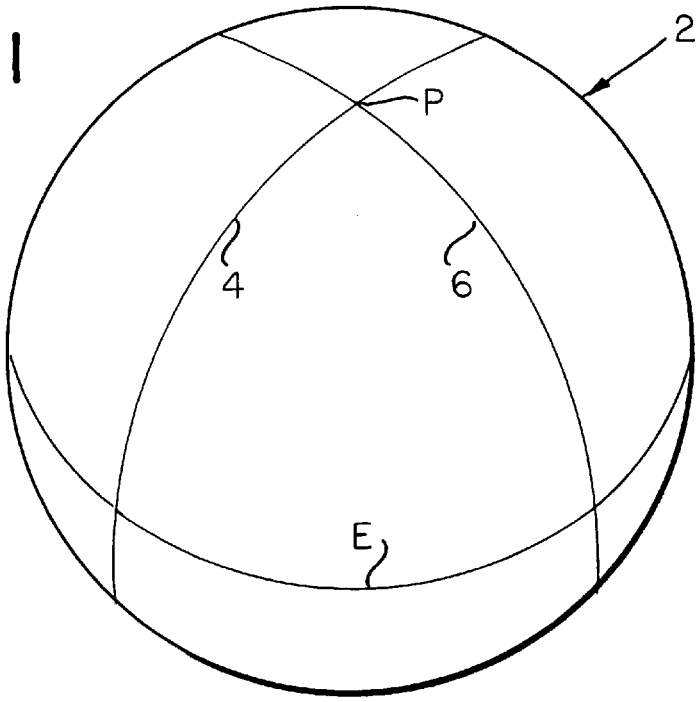
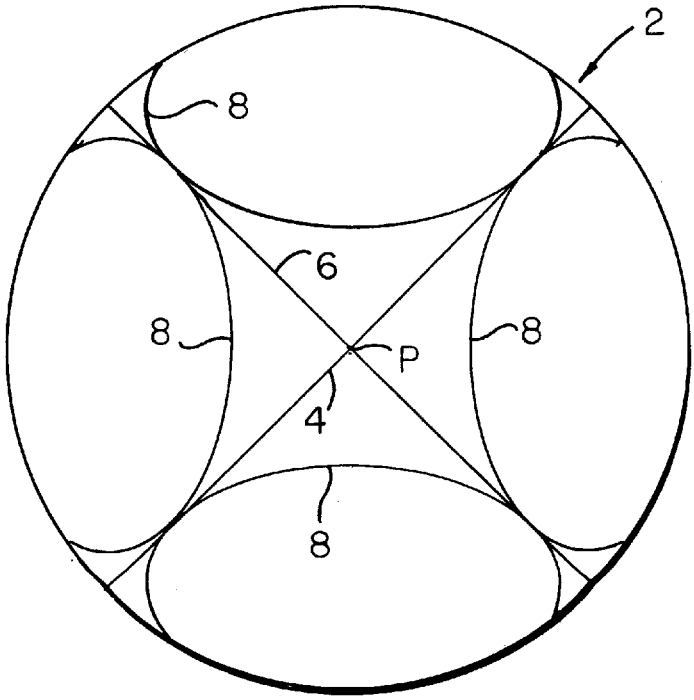
FIG. 2

GOLF BALL HAVING CIRCULAR GROUPS OF TEAR DROPPED DIMPLES

BACKGROUND OF THE INVENTION

The present invention relates generally to golf balls and more particularly to the arrangement of tear-drop shaped dimples on the surface of the ball.

Dimples are provided in the surface of a golf ball in order to control and improve the flight of the ball. One of the basic criteria for the use of dimples is to cover the maximum surface of the ball with dimples without diminishing the aerodynamic symmetry of the ball in order to satisfy the requirements of the United States Golf Association (U.S.G.A.). Aerodynamic symmetry means that the ball must fly in substantially the same manner with little variation regardless of how it is placed on a tee or on the ground.

BRIEF DESCRIPTION OF THE PRIOR ART

It is known in the art to provide a golf ball having an octahedral pattern about its surface, as shown by the Stiefel et al U.S. Pat. No. 5,735,756, which is owned by the assignee of the present invention. In this prior patent, there are displayed four identical quadrants in each hemisphere of the golf ball with a circular area filling each quadrant as completely as possible. A dimple is provided at each pole and the circular areas are filled with dimples, as are the areas between the circular areas and the poles. All of the dimples have a circular configuration. Thus, there is a limit to the area of the golf ball surface which is covered with dimples.

It is also known in the art to provide a golf ball with non-circular dimples, as evidenced by the U.S. Pat. No. to Ihara No. Des. 319,676, Machin U.S. Pat. No. 5,377,989, and Lu U.S. Pat. No. 5,503,398. A major drawback of these prior golf balls is that the patterns for arranging the dimples on the golf ball are inefficient, resulting in inherent deficiencies in aerodynamic symmetry.

The present invention was developed in order to overcome these drawbacks of the prior art by providing a golf ball with a plurality of modified tear-drop shaped dimples arranged in a unique configuration on the surface of the ball in order to maximize dimple coverage and improve aerodynamic efficiency of the ball.

SUMMARY OF THE INVENTION

Accordingly, it is a primary object of the invention to provide a golf ball having a dimple-free equatorial line which divides the ball into two hemispheres, each having a pole and substantially identical dimple configurations. Each hemisphere is divided into four identical quadrants defined by two imaginary great circles which intersect the poles, and each quadrant includes a circular area of maximum diameter. A first plurality of non-circular dimples are arranged within each circular area and a second plurality of non-circular dimples are arranged between the circular areas to increase the dimple coverage on the surface of the ball and to improve the aerodynamic efficiency of the ball.

According to another object of the invention, all of the dimples have a modified tear-drop configuration which is non-symmetric from a head portion to a tail portion thereof According to yet another object of the invention, the first plurality of dimples within each circular area comprise an outer ring of first dimples oriented in one direction and an inner ring of second dimples oriented in an opposite direction, the second dimples being smaller than the first dimples. Within the inner ring of second dimples are a pair of third dimples.

It is a further object to arrange the second plurality of dimples in a diamond configuration including fourth and fifth dimples oriented in opposite directions. none of the dimples on the surface of the ball overlap and the poles are dimple-free.

BRIEF DESCRIPTION OF THE FIGURES

Other objects and advantages of the invention will become apparent from a study of the following specification when viewed in the light of the accompanying drawing, in which:

FIG. 1 is a perspective view of a golf ball according to the invention showing the arrangement of great circle lines on the surface thereof;

FIG. 2 is a polar view of the golf ball illustrating the arrangement of circular areas within the quadrants of a hemisphere defined by the great circles of FIG. 1;

DETAILED DESCRIPTION

Figure 3:
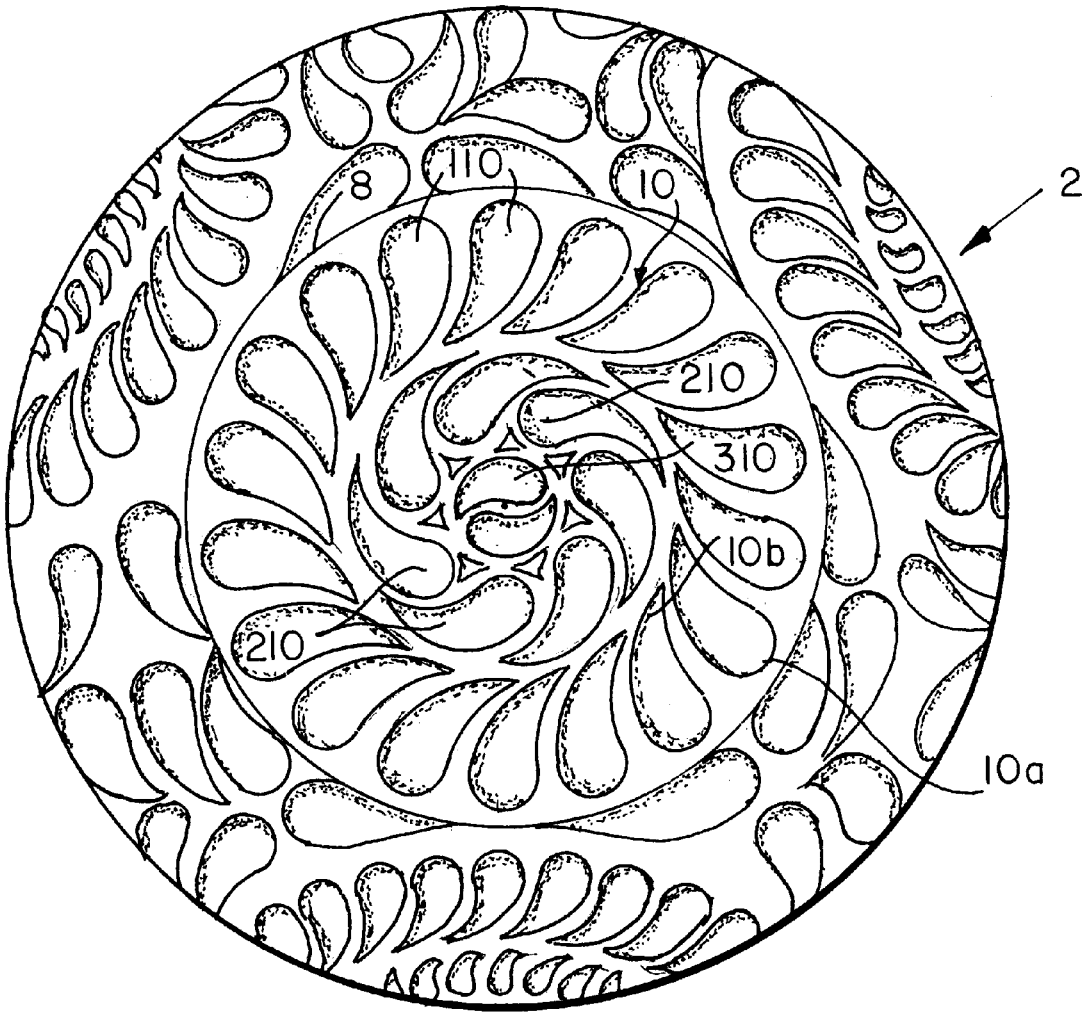
FIG. 3 is a plan view of a circular area of FIG. 1 with modified tear-drop shaped dimples arranged therein according to the invention.

Referring first to FIGS. 1 and 2, there is shown a golf ball 2 having an equator E which divides the ball into two hemispheres, each of which contains a pole P. As will be developed in greater detail below, the equator is dimple-free and the dimple patterns in each hemisphere are identical. Each hemisphere is divided into four identical quadrants defined by two imaginary great circles 4, 6 which intersect the poles. As shown in FIG. 3, each quadrant includes a circular area 8 of maximum diameter. That is, each circular area is completely arranged within each quadrant with no overlapping of the circles or extension of the circles beyond their corresponding quadrants.

Each circular area 8 (of which there are four in each hemisphere and eight across the surface of the golf ball) is filled with a plurality of first non-circular dimples 10 as shown in FIG. 3. The dimples have a modified tear-drop shape as defined by the edge of each dimple where it meets the surface of the ball. More particularly, each dimple 10 has a head portion 10*a* and a tail portion 10*b*, the head portion being broader with the dimple tapering toward the tail portion. The dimples are thus non-symmetric from the head to the tail. Moreover, each dimple has a curvature or orientation relative to a radius r of the circular area which passes longitudinally through each dimple.

According to a preferred embodiment, the first plurality of dimples 10 includes an outer ring of dimples 110 and an inner ring of dimples 210, the rings being concentric. As shown in the drawing, the dimples 110 of the outer ring have their head portions arranged at an outer portion of the outer ring and their tail portions arranged at the inner portion of the outer ring. The dimples 110 of the outer ring all have the same orientation relative to their corresponding radius. The dimples 210 of the inner ring have their head portions arranged at an inner portion of the inner ring and their tail portions arranged at the outer portion of the inner ring. Each of the dimples 210 have the same orientation relative to their corresponding radius. This orientation is the reverse of the orientation of the dimples 110 of the outer ring. The dimples 210 of the inner ring are also preferably smaller than the dimples 110 of the outer ring.

At the center of the circular area within the inner ring of dimples 210 are a pair of dimples 310. As with the dimples of the inner and outer rings of dimples, the center dimples 310 are also of a modified tear-drop configuration which is non-symmetric from the head portion to the tail portion.

Figure 4:
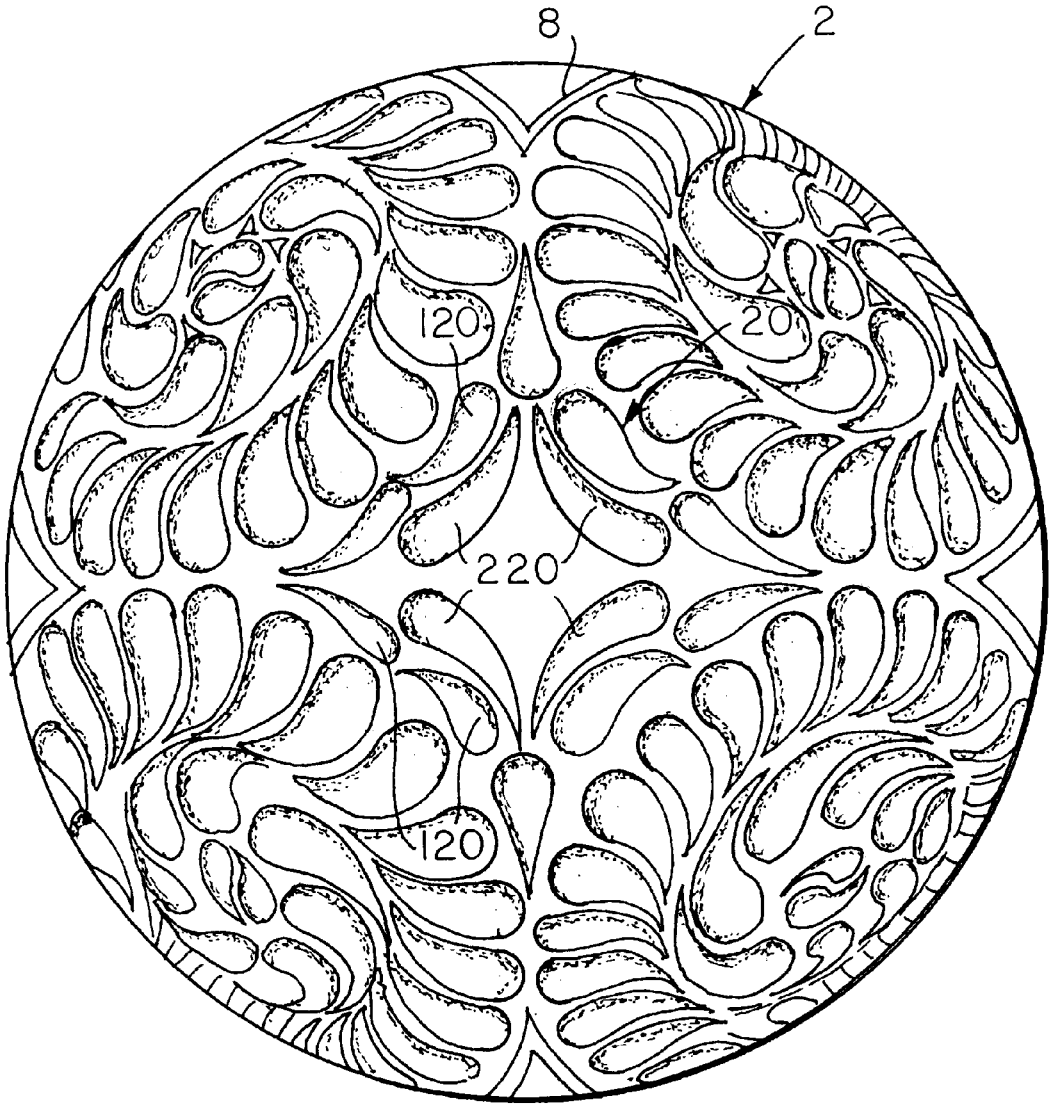
FIG. 4 is a polar view of the golf ball of FIG. 3 illustrating the arrangement of dimples between the circular areas.

A second plurality of non-circular dimples 20 is arranged between the circular areas in each hemisphere of the golf ball as shown in FIG. 4. These dimples are arranged in a diamond configuration and include two sets of dimples 120, 220 which are oriented in opposite directions. As with the first plurality of dimples 10, the second plurality of dimples 20 are also of a modified tear-drop configuration. The two sets of second dimples 120 and 220 preferably have different sizes. The center area of the diamond defined by the second plurality of dimples is dimple-free. Thus the poles of the golf ball are dimple-free. None of the dimples on the surface of the ball overlap.

With the modified tear-drop dimples arranged as shown on the surface of a golf ball, the dimple coverage on the surface of the ball is increased. Moreover, the tear-drop dimples and the dimple pattern according to the invention improve the aerodynamic efficiency of the ball.

While in accordance with the provisions of the Patent Statute the preferred forms and embodiments of the invention have been illustrated and described, it will become apparent to those of ordinary skill in the art that various changes and modifications may be made without deviating from the inventive concepts set forth above.

What is claimed is:

1. A golf ball having a dimpled surface, comprising (a) a dimple free equatorial line dividing the ball into two hemispheres, each hemisphere having a pole and substantially identical dimple configurations;

(b) each of said hemispheres being divided into four identical quadrants defined by two imaginary great circles which intersect said pole, each of said quadrants including a circular area of maximum diameter;

(c) a first plurality of non-circular dimples arranged within each of said circular areas; and (d) a second plurality of non-circular, non-symmetric dimples arranged between said circular areas, whereby the dimple coverage on the surface of the golf ball is increased to improve the aerodynamic efficiency of the ball.

2. A golf ball as defined in claim 1, wherein said first and second plurality of non-circular dimples have a modified tear-drop configuration which is non-symmetric from a head portion to a tail portion thereof.

3. A golf ball as defined in claim 2, wherein said first plurality of dimples are arranged in a predetermined pattern which is identical within each of said circular areas.

4. A golf ball as defined in claim 3, wherein said predetermined pattern comprises outer and inner concentric rings of first and second dimples, respectively.

5. A golf ball as defined in claim 4, wherein said first dimples have head portions arranged at an outer portion of said outer ring and tail portions arranged at an inner portion of said outer ring, each of said first dimples having the same orientation from head to tail relative to a radius of said imaginary circle.

6. A golf ball as defined in claim 5, wherein said second dimples have head portions arranged at an inner portion of said inner ring and tail portions arranged at an outer portion of said inner ring, each of said second dimples having the same orientation from head to tail relative to a radius of said circular area.

7. A golf ball as defined in claim 6, wherein said second dimples are smaller than said first dimples.

8. A golf ball as defined in claim 7, wherein said first plurality of dimples further comprises a pair of third dimples arranged within said inner ring.

9. A golf ball as defined in claim 8, wherein said second plurality of dimples are arranged in a diamond configuration.

10. A golf ball as defined in claim 9, wherein said second plurality of dimples comprise fourth and fifth dimples oriented in opposite directions.

11. A golf ball as defined in claim 10, wherein said fourth and fifth dimples have different sizes.

12. A golf ball as defined in claim 11, wherein none of said dimples overlap.

13. A golf ball as defined in claim 12, wherein the poles are dimple-free.

* * * * *